US006874345B2

(12) United States Patent
Stoynoff, Jr.

(10) Patent No.: US 6,874,345 B2
(45) Date of Patent: Apr. 5, 2005

(54) SERPENTINE FIN WITH EXTENDED LOUVERS FOR HEAT EXCHANGER AND ROLL FORMING TOOL FOR MANUFACTURING SAME

(75) Inventor: Richard P. Stoynoff, Jr., Woodhaven, MI (US)

(73) Assignee: Outokumpu Livernois Engineering LLC, Dearborn, MI (US)

( * ) Notice: Subject to any disclaimer, the term of this patent is extended or adjusted under 35 U.S.C. 154(b) by 0 days.

(21) Appl. No.: 10/335,618

(22) Filed: Jan. 2, 2003

(65) Prior Publication Data

US 2004/0251004 A1 Dec. 16, 2004

(51) Int. Cl.[7] ..... B21D 53/04
(52) U.S. Cl. ..... 72/186
(58) Field of Search ..... 72/186

(56) References Cited

U.S. PATENT DOCUMENTS

| | | | | |
|---|---|---|---|---|
| 2,789,797 A | | 4/1957 | Simpelaar | |
| 3,003,749 A | | 10/1961 | Morse | |
| 3,367,161 A | | 2/1968 | Avakian | |
| 3,998,600 A | | 12/1976 | Wallis | |
| 4,067,219 A | | 1/1978 | Bianchi | |
| 4,170,122 A | * | 10/1979 | Cowell | 72/186 |
| 4,328,861 A | | 5/1982 | Cheong et al. | |
| 4,676,304 A | | 6/1987 | Koisuka et al. | |
| 4,888,972 A | * | 12/1989 | Rouse | 72/186 |
| 5,271,458 A | | 12/1993 | Yamamoto et al. | |
| 5,372,187 A | | 12/1994 | Haushalter | |
| 5,511,610 A | | 4/1996 | Lu | |
| 5,679,106 A | | 10/1997 | Ohno et al. | |
| 5,682,784 A | | 11/1997 | Stoynoff, Jr. | |
| 5,738,169 A | | 4/1998 | Stoynoff | |
| 5,787,972 A | | 8/1998 | Beamer et al. | |
| 5,855,240 A | | 1/1999 | Farrell et al. | |
| 6,170,566 B1 | | 1/2001 | Blumel et al. | |

FOREIGN PATENT DOCUMENTS

| | | | | |
|---|---|---|---|---|
| JP | 63-273521 | * | 11/1988 | 72/186 |
| JP | 6-79358 | * | 3/1994 | 72/186 |

* cited by examiner

*Primary Examiner*—Lowell A. Larson
(74) *Attorney, Agent, or Firm*—Brooks Kushman P.C.

(57) ABSTRACT

A heat exchanger comprising at least one row of flattened tubes through which a heat exchange medium may pass. A serpentine fin 10 disposed between adjacent flattened tubes has relatively straight segments that are connected by bend radii 20. The fin 50 defines a plurality of louvers 32 therein. Each louver 32 forms an elongated slit that extends at least partially into the bend radii 20, through which a fluid to be heated or cooled by the medium may pass. The fin 50 is formed by a tool with fin blades that have tips that are configured to form the extended length louver that protracts into the bend radius that separates adjacent convolutions.

5 Claims, 6 Drawing Sheets

SERPENTINE FIN WITH EXTENDED LOUVERS FOR HEAT EXCHANGER AND ROLL FORMING TOOL FOR MANUFACTURING SAME

BACKGROUND OF THE INVENTION

1. Field of the Invention

This invention relates to a heat exchanger fin with louvers having an extended length and to a roll forming tool for use in manufacturing such louvers. More specifically, the present invention relates to a roll forming tool for manufacturing such louvers on a heat exchanger that utilizes physical media to either extract heat or cold from a source.

2. Background Art

It is generally known that a layer or film of fluid of indefinite thickness exists when a heat- or cold-transferring fluid contacts with a surface having a different thermal energy than the fluid. That layer is in direct contact with the heating surface, to which it tends to adhere and form a relatively thermally insulating covering. That covering reduces the rate of transfer of thermal energy. Such adherence is explained by friction between the fluid and the surface which causes the layer to move more slowly in relation to the more remote layers of fluid which may pass relatively unencumbered over the adherent layer. Such phenomena tend to diminish the efficiency of a heat exchanger. As a result, prior art heating approaches have used relatively large areas of heating surface in order to heat a fluid to a desired temperature.

Broadly stated, these prior art approaches have addressed the problem by disturbing this essentially non-conductive layer and enabling most of the fluid to be heated or cooled to come into direct contact with the heating or cooling surface respectively by modifying the surface. Such approaches, however, have been only somewhat effective in raising the efficiency of a heat exchanger.

The surface over which the heat transfer occurs is called a fin or louver. The louver deflects or directs the air and channels heat or coldness from a source. In existing louver designs, little turbulence actually occurs and laminar flow is relatively uninterrupted. These louvers or fins are commonly used to deflect air in conventional heat exchangers. Other uses for such structures have included deployment in air filters, air deflectors, structural spacers, noise reducers, and some components for electrical devices. Other details of the louvers and their characteristics are disclosed in commonly owned U.S. Pat. Nos. 5,682,784 and 5,738,169 which are hereby incorporated by reference.

The louvers or fins are typically produced by a roll forming tool called a finroll. Existing roll finrolls include a set of rolls which are each part of a rotating assembly. They are designed so that when they are mated and rolled in unison with each other, they produce a louvered serpentine fin from a strip of material that is introduced into the mating area of the finrolls. Existing finrolls are made up of a series of differently shaped blades or disks which are characterized by an outer peripheral shape and thickness. The thickness of each blade is a variable and is determined usually by the width of the louver that is to be manufactured. The outer perimeter of the disk is used to either preform or finish form the serpentine shape. It is also known to provide an offset on non-symmetrical blade flanks on the finroll to compensate for unequal rolling stresses induced into the fins.

SUMMARY OF THE INVENTION

One object of the present invention is to provide a heat exchanger fin with louvers of an extended length in relation to prior art approaches in order to enhance the efficiency of transfer of thermal energy.

It is more specifically an object of the present invention to provide elongated louvers that extend into a bend radius that joins adjacent convolutions in a serpentine heat exchanger.

It is also an object of the present invention to provide a tool having blade edges for producing a louver of an extended length that will provide for more efficient heat transfer.

By use of the disclosed tool, a protracted or extended edge is formed on the louvers that extends into the bend radius for creating additional fluid flow in comparison to prior art approaches. This flow of the fluid across the associated louver promotes a transfer of thermal energy between the medium in the tubes and the fluid.

The tool for manufacturing the louvered serpentine fins is a roll forming tool that simultaneously rolls, cuts, and forms serpentine fins with protracted edges that have turbulating characteristics. These steps are undertaken without the removal of material. The tool is comprised of a pair of intermeshing stacked sets of star-shaped blades. Each blade has a plurality of protracted cutting edges that cut the work-piece, such as a piece of copper or aluminum, to form the louvered serpentine fins while also providing for extended tool life. The blades contact the workpiece where the pair of stacked sets of star-shaped blades intermesh.

DETAILED DESCRIPTION OF THE PREFERRED EMBODIMENT(S)

Broadly stated, the present invention includes a heat exchanger comprising at least one row of flattened tubes through which a heat exchange medium may pass. At least one serpentine fin is supported between adjacent tubes. Each fin defines a plurality of louvers therein, each louver forming an elongated slit through which a fluid to be heated or cooled by the medium may pass. The louvers are oriented orthogonally to a direction of fluid flow between the tubes. The serpentine fin has a plurality of undulating sections that are connected by a bend radius or a bridging section. In contrast to prior exchangers of thermal energy, the louvers extend from the undulating sections at least partially into the bridging sections.

One consequence of this structure is that the louver is located closer to the flattened tube than in prior art approaches. This has been the effect of promoting the efficiency of transfer of thermal energy in comparison to prior art exchangers that have louvers which terminate before the bend radii.

The disclosed invention has two interrelated aspects: the fin forming roll, which is used to manufacture such a fin, and the extended length louver defined in the fin thereby.

The Roll Forming Tool

Figure 1:
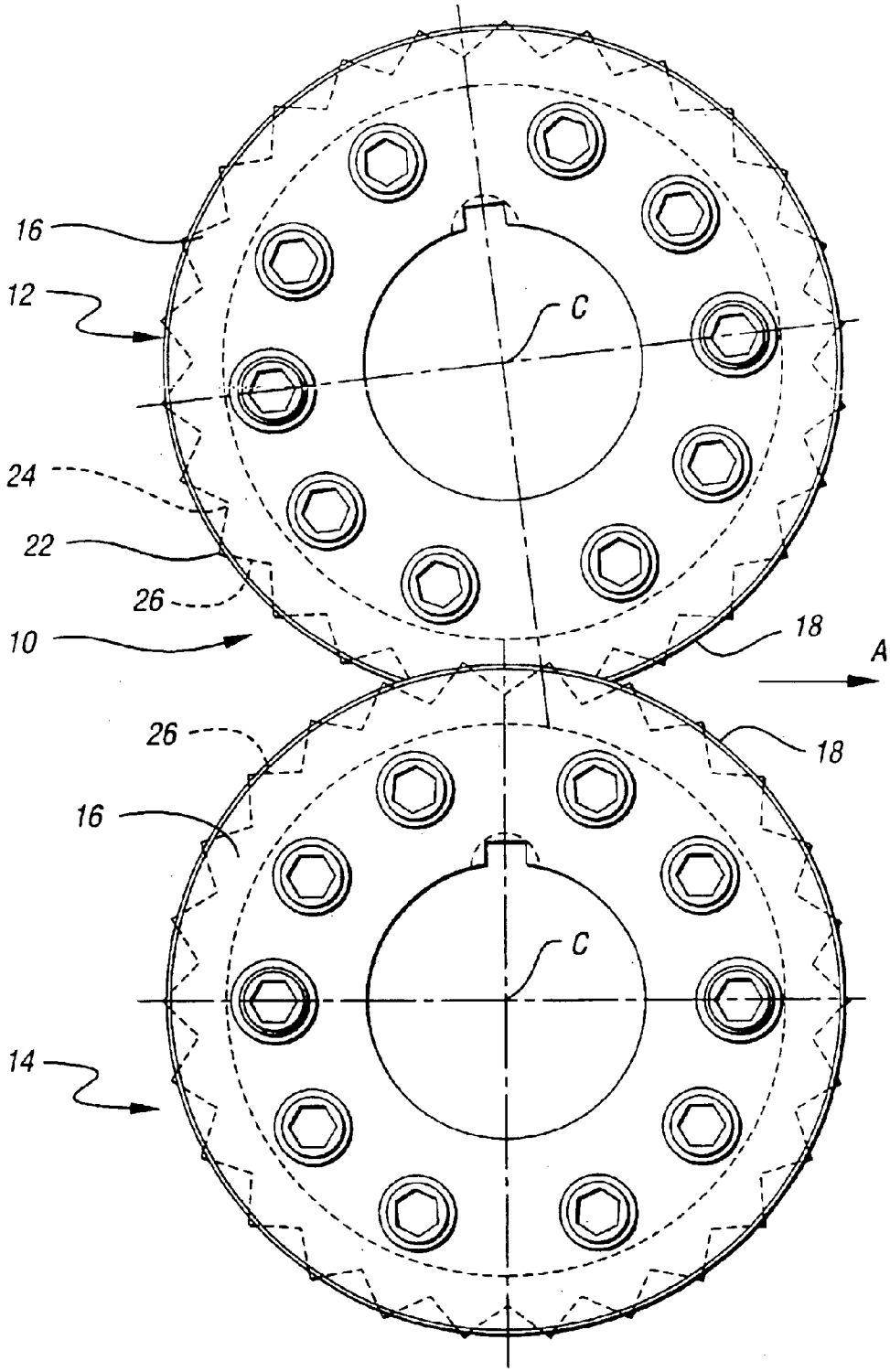
FIG. 1 illustrates a pair of roll forming tools for manufacturing the extended length louvered serpentine fins in accordance with the present invention.
Figure 2:
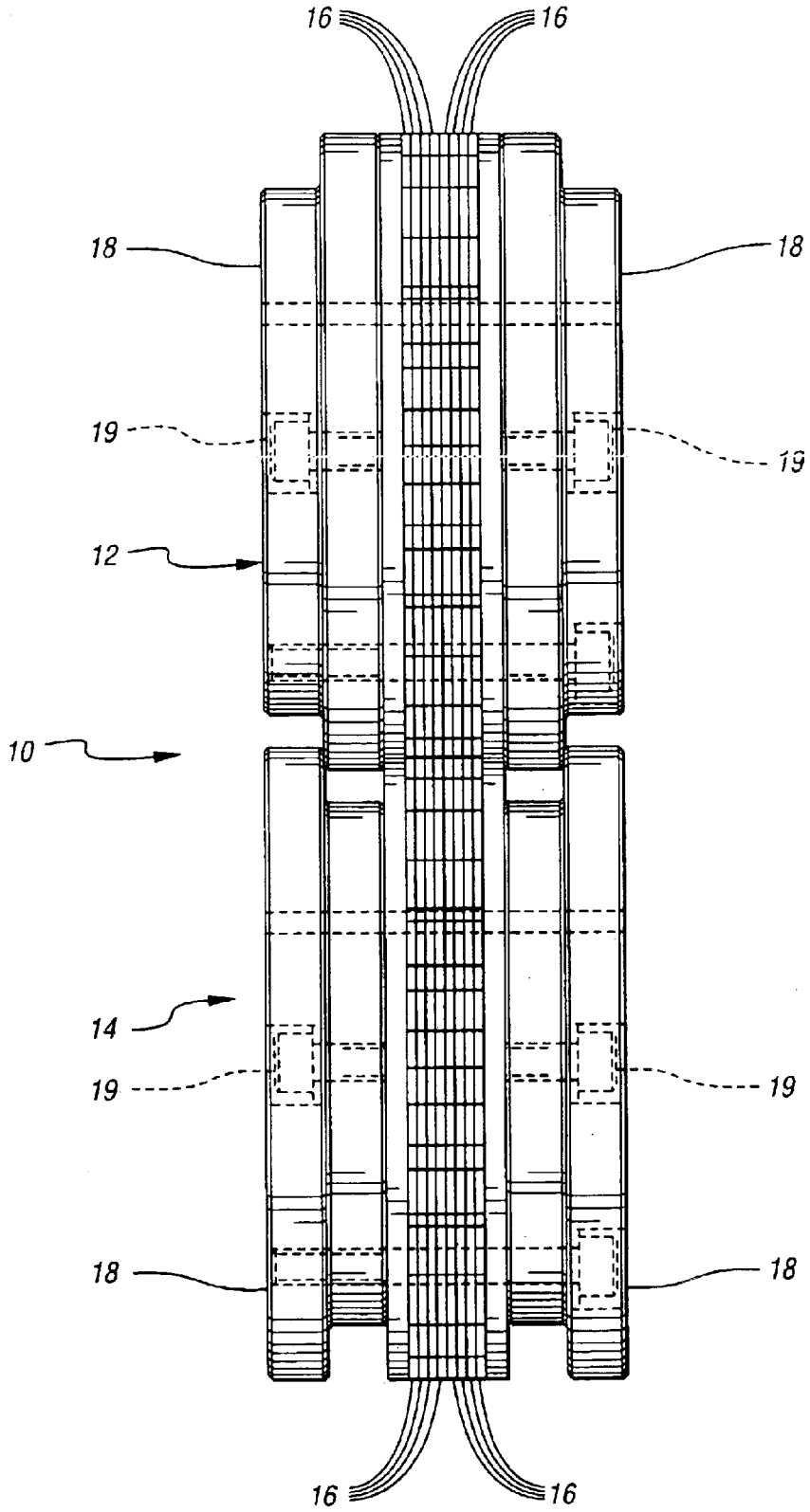
FIG. 2 is a side view of a roll forming tool used to manufacture the extended length louvered serpentine fins in accordance with the present invention.
Figure 4:
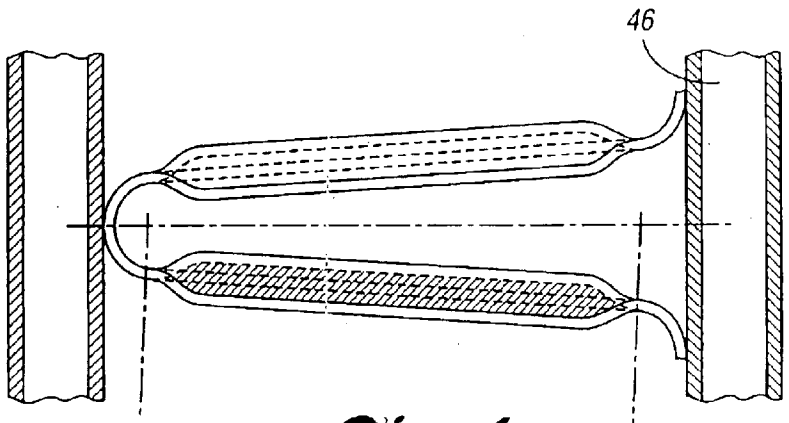
Fig. 4 (PRIOR ART)
FIG. 4 is a sectional view of a conventional louvered serpentine fin.

As shown in FIGS. 1 and 2, the tool 10 for forming these louvers is a roll forming tool. The roll forming tool 10 of the present invention includes two circular wheel assemblies 12, 14. Each of the wheel assemblies 12, 14 is generally circular and includes a plurality of star-shaped fin blades 16 stacked upon one another. As will be described in more detail later, one aspect of the present invention relates to the tip geometry of the star-shaped fin blade 16.

The star-shaped fin blades 16 of wheel assembly 12 are located such that they intermesh with the star-shaped fin blades 16 of the wheel assembly 14. The fin blades 16 of each wheel assembly 12, 14 are sandwiched between a pair of end plates 18. The end plates 18 are secured to the blades 16 and the opposing end plate 18 by a fastener 19, such as a bolt or the like.

Each wheel assembly 12, 14 rotates around its center axis or center point (C) such that the fin blades 16 mate and cut, roll, and form serpentine louvers in a workpiece, such as a piece of metal, inserted between the wheel assemblies, as shown by the arrow A in FIG. 1.

The star-shaped fin blades 16 of the present invention each include a plurality of teeth. The teeth each have a peak or tip 22 and a valley 24. In between each peak 22 and each valley 24 exists a complex blade surface 26 which cuts and forms the extended louver of the manufactured fin. If desired, this surface 26 can have a plurality of serrations that form a plurality of scallops on the louvers 32 of each fin 34 (not shown), as disclosed in U.S. Pat. No. 5,682,784.

Figure 6:
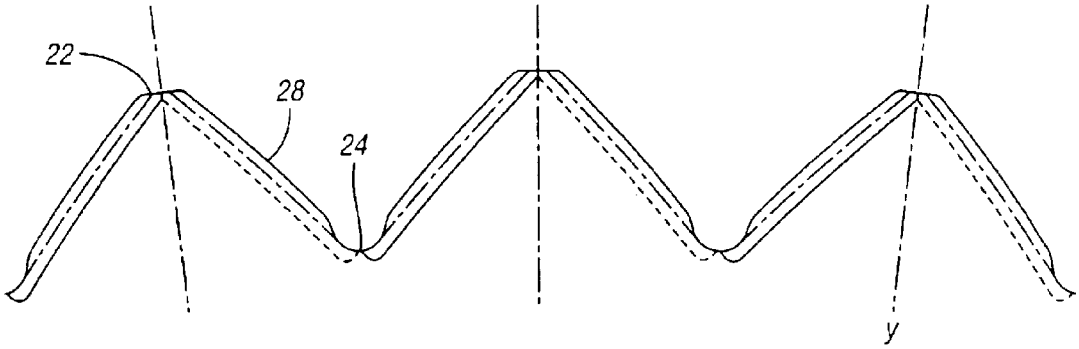
Figure 7:
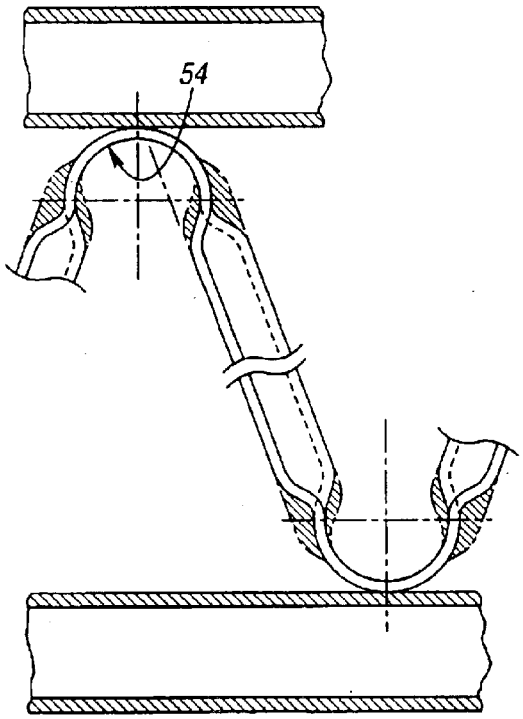
FIG. 7 is an enlarged view that compares the louver formed inventively and conventionally.

The cutting and forming surface 26 of the preferred tool has edges that are more widely separated (FIG. 6) near the valley 24 than at the tip or peak 22. The valley 24 can be symmetrical about line "y" or non-symmetrical.

Figure 5:
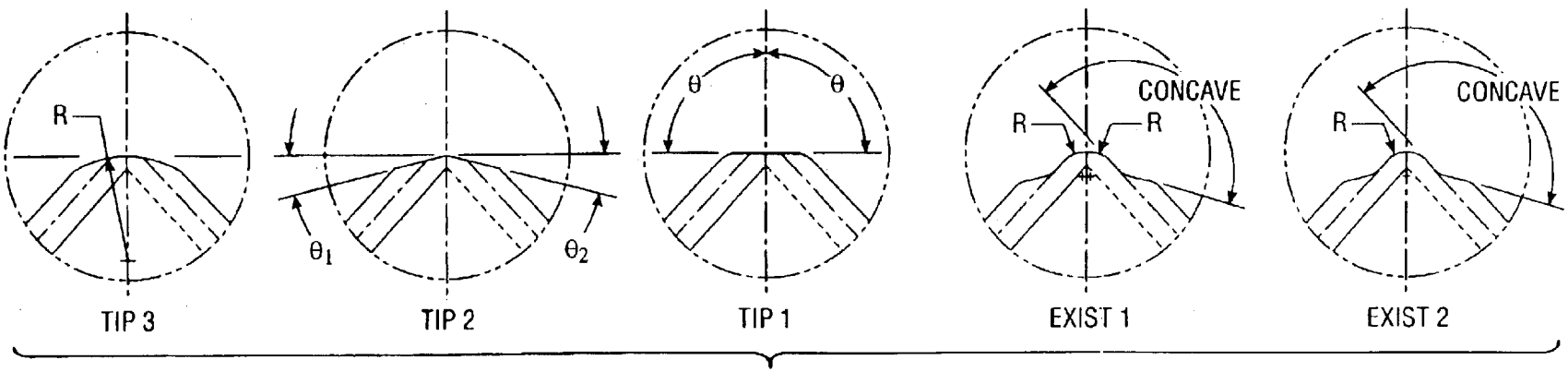
FIGS. 5 and 6 are side views of a tip of the roll forming tool (enlarged—FIG. 5 and context—FIG. 6) views of a blade used (conventionally (exist 1, 2) and inventively (tips 1–3)) to manufacture the louvered fins in accordance with the present invention.

Continuing with reference to FIG. 5, the drawings labeled EXIST 1 and EXIST 2 depict conventional tip designs. They are characterized by one or more radii (R) and have adjacent concavities. In contrast, the inventive tips 1–3 have a geometry which creates an elongated louver and includes shoulder portions (e.g., tip 2) that are inclined (e.g., at an angle θ of up to about 30°) in relation to a local tangent line. In an alternate embodiment, the shoulder portions are coincident (tip 1) with a tangent line. In yet another embodiment, the tip has a radius (R) from which the cutting edge extends without the shouldered portions that typify conventional approaches (exist 1, 2). It is not necessary for the tip to be symmetrical about line "y" if compensation for louver shift is to be applied. The angles $\theta_1$ and $\theta_2$ can differ.

In the preferred embodiment, the finroll is manufactured with high grade tool steel, details of which are disclosed in U.S. Pat. No. 5,588,319 entitled "Method and Apparatus For Making Heat Exchange Fins", which is hereby incorporated by reference. However, any fin blade material that is capable of supporting, cutting, rolling and forming the plain louvered fin is also acceptable.

The Extended Length Louver

The tool of the present invention cuts, rolls, and forms extended length louvers which create minute eddies and currents that scrub the heat exchanger surface and thermal energy is more efficiently transferred to the turbulated media.

Figure 3:
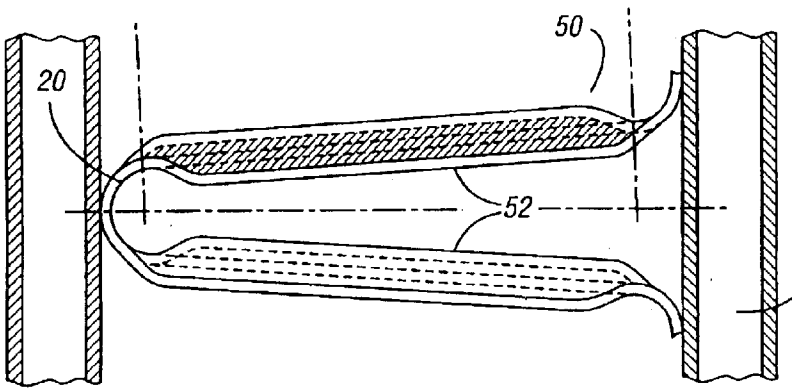
FIG. 3 is a sectional view of an extended length louvered serpentine fin disposed in a heat exchanger manufactured by the disclosed tool in accordance with the present invention.
Figure 8:
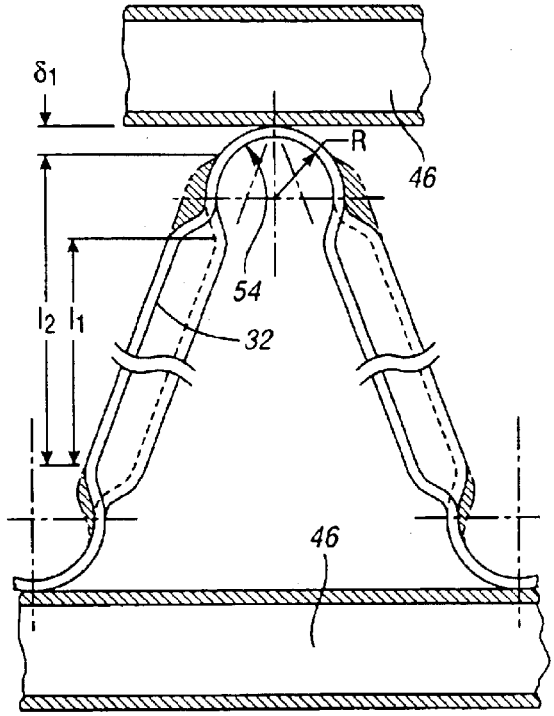
FIG. 8 is an enlarged view of the inventive louver that illustrates extended louver segments, and their characterizing features that distinguish them from traditional approaches.
Figure 9:
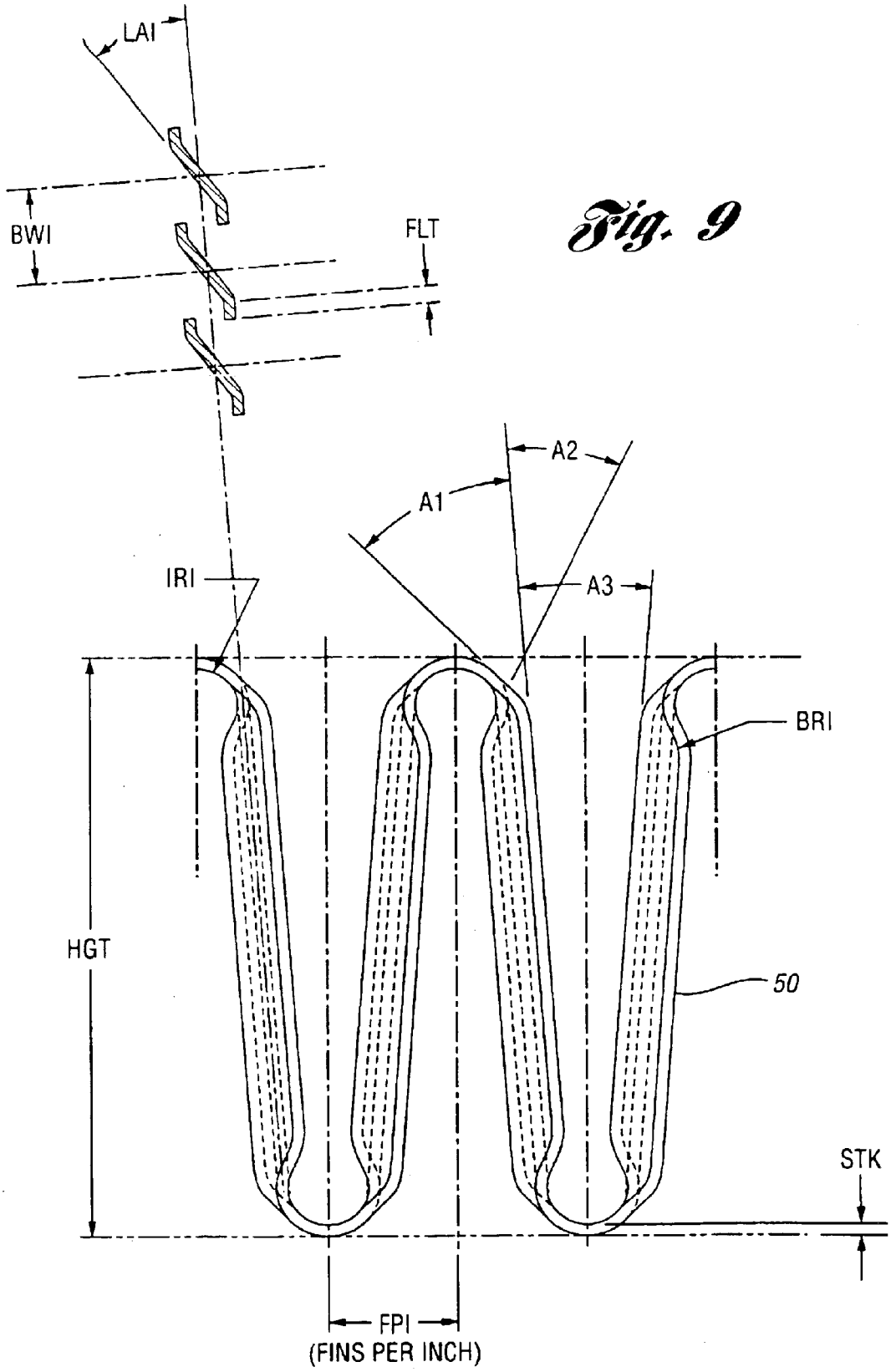
FIG. 9 depicts further detail of the louver form according to the roll forming tool of the present invention.

This aspect of the invention will now be described in more detail. Disposed between a row of flattened tubes 46 in a heat exchanger through which a heat exchange medium may pass is at least one serpentine fin 50 (FIGS. 3, 8–9). The serpentine fin 50 has relatively straight segments 32 that are connected by bend radii r. An enlarged view appears in FIG. 9. As shown in FIG. 8, the serpentine fin 50 is supported between adjacent tubes 46. Each louver forms an elongated slit 52 (FIG. 3) that extends at least partially into the associated bend radii 20 so that the fluid to be heated or cooled by the medium which flows through the flattened tubes may pass.

As depicted in FIG. 8, the bend radii are formed by an arc having a relatively constant radius (r). Continuing with reference to FIG. 8, the serpentine fin comprises a transition section 54 between the end of a louver 32 and a flattened tube 46.

In FIG. 8, the length $l_1$ denotes the length of a conventional louver or slit. The length $l_2$ denotes the length of the extended louver that is the subject of the present invention. As depicted, $l_2$ exceeds $l_1$.

The letter δ denotes the distance of the bridging section 54 extending between the end of the extended length louver and the flattened tube. The shaded area in FIG. 8 represents the additional area through which the medium to be heated or cooled may pass as a result of the extended length louver of the present invention.

Turning now to FIG. 9, further details of the extended length louver formed by the disclosed fin forming roll are depicted. The following table reflects the preferred ranges of the disclosed characterizing variables in inches and angular degrees:

| VARIABLE | MINIMUM | MAXIMUM |
|---|---|---|
| HGT | .060 | 1.000 |
| IR1 | .006 | .060 |
| A1 | 30° | 80°-A3 |
| A2 | 8° | 45° |
| STK | .001 | .015 |
| BR1 | .010 | .100 |
| FPI | 1.4/HGT (in.) | 10.0/HGT (in.) |
| BW1 | .0200 | .2500 |
| LA1 | 10° | 45° |
| FLT | 0 | .125 |

If desired, optionally, a corrugated edge extends from a generally flat basal portion of one or more of the louvers for creating turbulence in the field, thereby disturbing laminar flow of the fluid across the louvers and promoting transfer of thermal energy between the medium in the tubes and the fluid.

Thus, there has been disclosed a turbulator fin having louvers that extend into the bend radii and an improved tool for manufacturing it to address concerns of cost, performance, and strength, while creating a direct replacement component for the currently used louvered serpentine fin.

Examples

Figure 10:
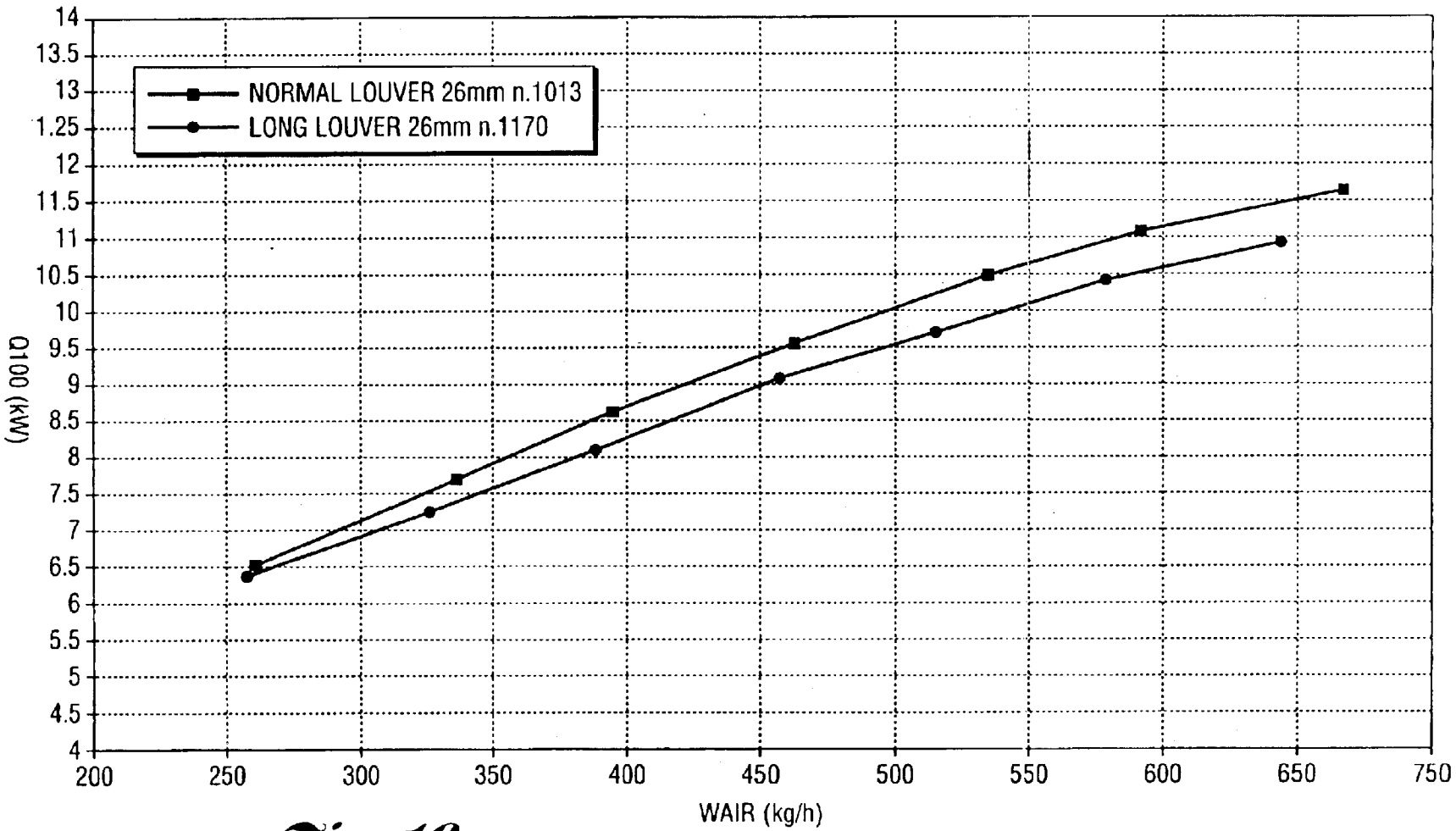
FIG. 10 is a graph of heat rejection (Q) versus air flow rate ($W_{air}$).

FIG. 10 depicts test data that support the efficacy of the disclosed invention. In FIG. 10, heat rejection (Q) is plotted against air flow rate ($W_{air}$). The two curves compare characteristics of a conventional fin to the inventive fin. In this case, the higher the heat rejection for a given air flow rate ($W_{air}$), the better.

It shows that for a given heat rejection (Q) the normal louver (lower line) permits a lower flow rate ($W_{air}$) than does the extended length louver (upper line). Correspondingly, for a given air flow rate ($W_{air}$), the heat rejection provided by the normal louver (lower line) is less than that provided by the extended length louver (upper line).

Therefore, the disclosed invention has a beneficial effect on the overall core performance, as compared to a conventional louver.

While only one preferred embodiment of the invention has been described hereinabove, those of ordinary skill in the art will recognize that this embodiment may be modified and altered without departing from the central spirit and scope of the invention. Thus, the embodiment described hereinafter is to be considered in all respects as illustrative and not restrictive, the scope of the invention being indicated by the appended claims, rather than by the foregoing descriptions, and all changes, which come within the meaning and range and equivalency of the claims are intended to be embraced herein.

What is claimed is:

1. A tool for manufacturing louvered serpentine fins with convolutions that include bend radii, the tool comprising:

two rotatable wheel assemblies;

a plurality of fin blades included in each of the wheel assemblies;

each of said fin blades including one or more teeth, each tooth having a peak and a valley connected by a protracted cutting edge of an extended length that forms louvers that extend into the bend radii of the serpentine fin, the peaks of adjacent blades being aligned; and one or more cutting surfaces, each cutting surface lying between a peak and a valley.

2. The tool of claim 1 wherein each fin blade has one or more teeth having a tip that extends uninterruptedly to a protracted cutting edge.

3. The tool of claim 2 wherein the tip has a section that lies tangentially to the fin blade.

4. The tool of claim 2 wherein at least one of the tips includes a shoulder portion that lies at an angle θ in relation to the tangent line.

5. The tool of claim 1 wherein a separation between adjacent cutting surfaces is wider across a valley than across a peak.

* * * * *